US005785593A

United States Patent [19]

Wood et al.

[11] Patent Number: 5,785,593

[45] Date of Patent: Jul. 28, 1998

[54] METHOD OF PLAYING A POKER GAME

[76] Inventors: Michael W. Wood; Terry L. Wilson, both of 11831 Wentling Ave., Suite #C, Baton Rouge, La. 70816

[21] Appl. No.: 899,078

[22] Filed: Jul. 23, 1997

[51] Int. Cl.[6] ..... A63F 1/00

[52] U.S. Cl. ..... 463/13; 273/292

[58] Field of Search ..... 273/292, 309, 273/274; 463/12, 13

[56] References Cited

U.S. PATENT DOCUMENTS 5,019,973 5/1991 Wilcox et al. ..... 364/412
5,431,408 7/1995 Adams ..... 273/306

*Primary Examiner*—Benjamin H. Layno
*Attorney, Agent, or Firm*—John Edward Roethel

[57] ABSTRACT

The player is dealt an initial hand of five cards. The player is offered the opportunity to swap certain of the first five initially dealt cards for a different card if two conditions exist: 1) the player must have a pair or three-of-a-kind of Deuces through Tens; and 2) two of the remaining cards of the player's first five initially dealt cards must add up numerically to the same rank as the cards forming the pair or three-of-a-kind. If both those conditions exist, the player is offered the opportunity to swap the two cards which add up to the rank of the player's pair or three-of-a-kind for another card of that rank. If the player chooses to accept the swap, the player's hand will then be improved from a pair to three-of-a-kind or from three-of-a-kind to four-of-a-kind prior to the draw step of the method of play. Alternatively, the player is offered a different swap opportunity if any two groups of the player's initially dealt cards add up, subtract from, multiply with or divide with each other to the same numerical value, then the player has the option of swapping the two groups of cards to create a pair or a three-of-a-kind prior to the draw step. The player then discards and draws replacement cards to attempt to further improve his hand.

16 Claims, 3 Drawing Sheets

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S,3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S,3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S,3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

50

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S,3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

50

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S,3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

METHOD OF PLAYING A POKER GAME

POKER GAME

This invention relates to a poker game, and more particularly to a poker game played on an electronic video gaming machine in which the player may improve his initially dealt hand in certain situations by swapping two dealt cards for another card.

BACKGROUND OF THE INVENTION

Video poker machines have been present in gaming casinos for many years. Each video poker machine is essentially a single player game. A hand of cards from a deck is dealt to the player and displayed on the video screen. The player selects which cards to hold, and the unheld cards are discarded and replaced with new cards from the deck. The resulting hand is the final hand and the player wins or loses based on the poker hand ranking of his final hand.

The video poker gaming machine is designed to replicate the play of a hand of poker. Typically, the player is not playing against any other player's hands or against a dealer's hand; the player is simply attempting to achieve the highest ranking poker hand possible from the cards displayed to the player. The higher the ranking of the poker hand achieved by the player, the greater the player's winnings based on the number of coins, tokens or credits wagered by the player. Typically, a pay schedule is posted on the gaming machine to advise the player of the payoffs available for certain winning card combinations.

Electronic video poker gaming machines use a computer program to shuffle the cards, deal the initial hand, deal replacement cards for the discarded cards and determine the poker hand ranking of the final hand. The first of the electronic video poker machines was the video Draw Poker machine that dealt cards from a standard 52 card poker deck and displayed a single five card hand to the player. The player then selected which of the five cards he wished to hold (or discard depending on the format of the gaming machine). The draw poker machine then displayed replacement cards for the cards the player had discarded. The player won or lost based on conventional poker hand rankings for the resulting five card hand.

In video Draw Poker, the conventional poker hand rankings that are winning combinations are a Royal Flush, a Straight Flush, a Four of a Kind, a Full House, a Flush, a Straight, a Three of a Kind, a Two Pair and a Pair of Jacks or Better. A pay table is established based on the number of coins, tokens or credits wagered by the player and the type of poker hand achieved.

This classic draw poker machine has been modified to use jokers as wild cards or to use deuces (or even other cards) as wild cards. "Joker's Wild" and "Deuces Wild" draw poker still display to the player a single five card hand and allow the player to discard unwanted cards and receive replacement cards. The pay table is modified to recognize the differing odds for achieving various poker hands when wild cards are involved. Furthermore, different poker hand rankings are used in the pay table to recognize different winning combinations that can be achieved using wild cards.

In conventional video draw poker, a typical pay schedule would be:

TABLE A

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND | 25 | 50 | 75 | 100 | 125 |
| FULL HOUSE | 9 | 18 | 27 | 36 | 45 |
| FLUSH | 6 | 12 | 18 | 24 | 30 |
| STRAIGHT | 4 | 8 | 12 | 16 | 20 |
| THREE-OF-A-KIND | 3 | 6 | 9 | 12 | 15 |
| TWO PAIR | 2 | 4 | 6 | 8 | 10 |
| JACKS OR BETTER | 1 | 2 | 3 | 4 | 5 |

Many different types of pay tables have been developed. Pay tables with large payouts for higher ranking poker hands have been used, but normally the money for these large payouts has been provided by lowering the payouts for the lower ranking poker hands.

In order to continue and increase player interest in electronic video poker, there is a need for new and exciting versions of these games. As with any amusement form, players have become disinterested in conventional video Draw Poker and many players perceive that conventional video Draw Poker has lost its challenge.

It is an object of the present invention to provide a new, exciting and challenging variation of conventional electronic video poker that will stimulate player interest.

It is a further object of the present invention to provide a variation to conventional electronic video poker by allowing the player to swap two of the cards from the player's initially dealt hand for another card and thereby improve the player's hand prior to the draw step taking place.

It is still a further object of the present invention to provide a variation to conventional electronic video poker by allowing the player to add, subtract, multiply or divide the numerical value of two or more of the cards from the player's initially dealt hand and substitute one or more new cards which have the numerical value of the addition, subtraction, multiplication or division and thereby improve the player's hand prior to the draw step taking place.

It is a feature of the present invention that 1) if the player has a pair or three-of-a-kind of cards in rank from Deuces through Tens, and 2) if two of the player's remaining cards add up to the same numerical value as the rank of the player's pair or three-of-a-kind of cards, then the player has the option of swapping the two cards adding up to the rank of the player's pair or three-of-a-kind of cards for another card of that same rank.

It is a further feature of the present invention that 1) if the player has a pair or three-of-a-kind of cards in rank from Deuces through Aces (with a Jack having a numerical value of 11, a Queen having a numerical value of 12, a King having a numerical value of 13 and an Ace having a numerical value of 14) and 2) if two of the player's remaining cards add up to the same numerical value as the rank of the player's pair or three-of-a-kind of cards, then the player has the option of swapping the two cards adding up to the rank of the player's pair or three-of-a-kind of cards for another card of that same rank.

It is still a further feature of the present invention that 1) assigning numerical values to each card based on the number if pips on that card with a Jack having a numerical value of 11, a Queen having a numerical value of 12, a King having a numerical value of 13 and an Ace having a numerical value of 14 and 2) if any two groups of the player's initially dealt cards add up, subtract from, multiply with or divide with each other to the same numerical value, then the player has the option of swapping the two groups of cards to create a pair or a three-of-a-kind prior to the draw step.

It is an advantage of the present invention that the player is provided with a unique swapping capability so that his initially dealt hand can be improved prior to the draw step of the method of play.

It is a further advantage of the present invention that the player is provided with a unique swapping capability based on the addition, subtraction, multiplication or division associations of the cards from his initially dealt hand whereby his initially dealt hand can be improved prior to the draw step of the method of play.

It is still a further advantage of the present invention that the player will perceive that he is receiving a special added edge during the play of the game. The player will feel that he is receiving the ability to swap two worthless cards for a more useful card and thereby improve his hand at no extra cost.

Other objects, features and advantages of the present invention will become apparent from a consideration of the following detailed description.

SUMMARY OF THE INVENTION

The present invention is a modification of conventional electronic video poker. The player is dealt an initial hand of five cards, all face up. The player is offered the opportunity to swap certain of the first five initially dealt cards for a different card if two conditions exist: 1) the player must have a pair or three-of-a-kind of Deuces through Tens; and 2) two of the remaining cards of the player's first five initially dealt cards must add up numerically to the same rank as the cards forming the pair or three-of-a-kind. If both those conditions exist, the player is offered the opportunity to swap the two cards which add up to the rank of the player's pair or three-of-a-kind for another card of that rank. If the player chooses to accept the swap, the player's hand will then be improved from a pair to three-of-a-kind or from three-of-a-kind to four-of-a-kind prior to the draw step of the method of play.

Alternatively, the player is offered a different swap opportunity if any two groups of the player's initially dealt cards add up, subtract from, multiply with or divide with each other to the same numerical value, then the player has the option of swapping the two groups of cards to create a pair or a three-of-a-kind prior to the draw step.

The player then discards and draws replacement cards to attempt to further improve his hand. After the draw step, the player's hand is evaluated to determine if a winning card combination exists and the player is paid an award based on the amount wagered by the player in accordance with a pay table.

DETAILED DESCRIPTION OF THE PREFERRED EMBODIMENTS

The present invention is a modification of conventional electronic video poker. In the basic form of conventional video poker, the player is dealt five cards all face up from a single fifty-two card deck. The player selects which cards to hold and discards the unwanted cards. Replacement cards are dealt from the same fifty-two card deck for the discarded cards and the player has a final five card hand. This hand is compared to a pay table based on conventional poker hand ranking. If the player has a winning hand he receives an award based on the number of coins, tokens or credits wagered by the player.

In the present invention, the player is dealt an initial hand of five cards, all face up. In the preferred embodiment of the present invention, the initial five cards are dealt from a pool of cards comprising a standard fifty-two card deck. However, alternatively, one or more Jokers can be added to the fifty-two card deck with the Jokers being used as wild cards during the play of the game.

After the deal of the initial five cards from the pool of cards, the player is offered the opportunity to swap certain of the first five initially dealt cards for a different card if two conditions exist: 1) the player must have a pair or three-of-a-kind of Deuces through Tens; and 2) two of the remaining cards of the player's first five initially dealt cards must add up numerically to the same rank as the cards forming the pair or three-of-a-kind. If both those conditions exist, the player is offered the opportunity to swap the two cards which add up to the rank of the player's pair or three-of-a-kind for another card of that rank. If the player chooses to accept the swap, the player's hand will then be improved from a pair to three-of-a-kind or from three-of-a-kind to four-of-a-kind prior to the draw step of the method of play.

Figure 1:
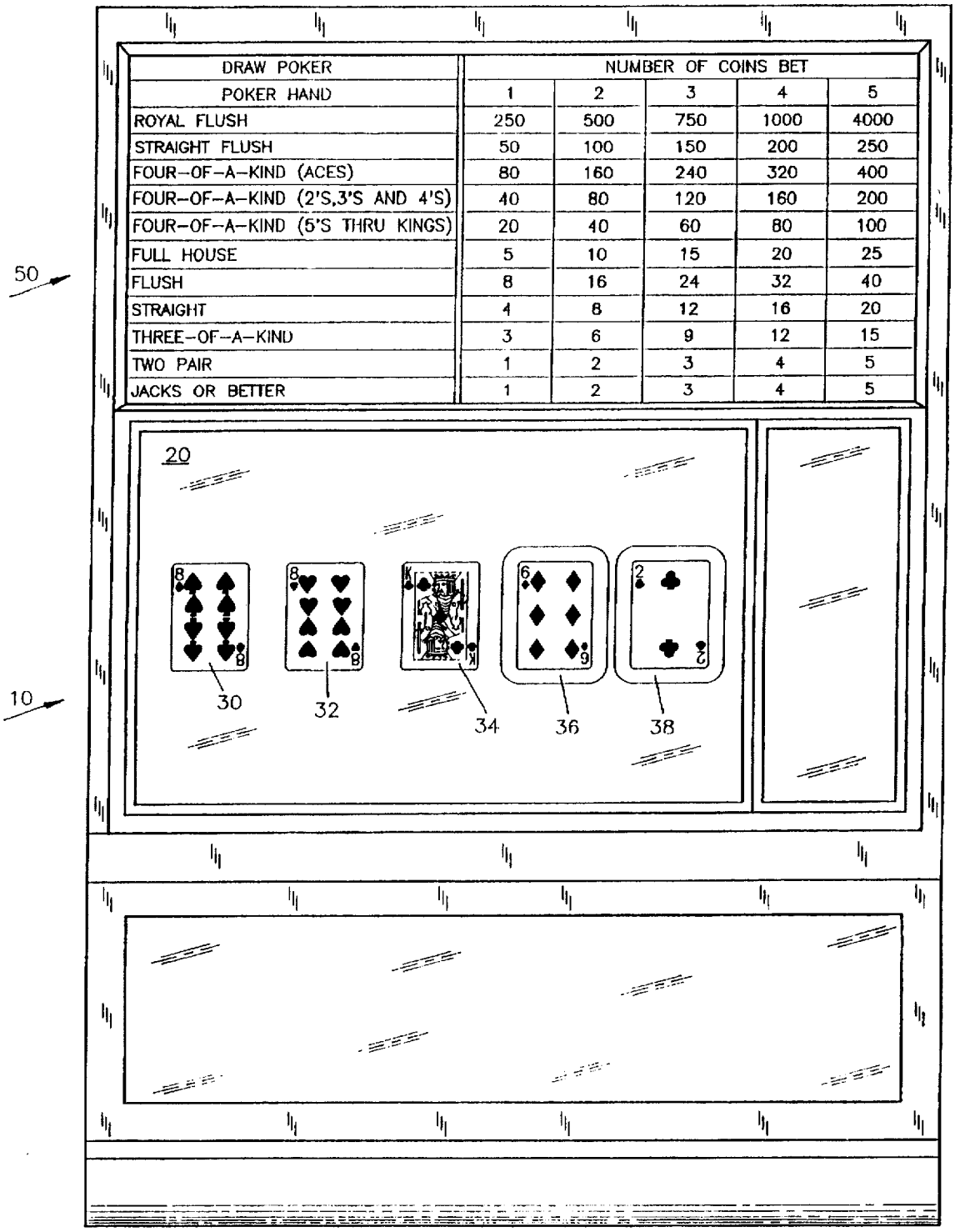
FIG. 1 shows a video screen display and pay table used in the method of the present invention after the initial deal of the first five cards to the player.

FIG. 1 shows an electronic video gaming machine 10 that is programmed to display the method of the present invention. The electronic video gaming machine has a video display screen 20 that shows the cards during the play of the hand. In a typical configuration, the pay table 50 is shown above the video display screen 20, although the pay table 50 can also be shown on a portion of the video display screen 20 if desired.

As an example of the method of play of the present invention, FIG. 1 shows an initial deal of five cards to the player. The player has received the 8♠ 30, the 8♥ 32, the K♣ 34, the 6♦ 36, and the 2♣ 38. On this initial deal, the player will be offered the opportunity to swap the 6♦ and the 2♣ for another Eight. The player is offered this opportunity because both of the required swap conditions are present. The player was dealt a pair (the 8♠ and the 8♥) between Deuces and Tens and two of the player's remaining cards from his initial hand (the 6♦ and the 2♣) add up numerically to the rank of the pair in the player's hand.

When a possible swap situation occurs, the player is alerted to the swap situation in any suitable manner by the electronics of the gaming machine. In the preferred embodiment of the present invention, the electronic gaming machine is programmed to visually display to the player the possible swap of cards that is available to the player. In one version of displaying the possible swap situation, the graphics can show the two cards to be swapped (for example, the 6♥ and the 2♣) to dissolve from the screen and be replaced by the one card to be substituted for the swap cards (for example, the 8♣). Alternatively, the graphics could simply highlight in bold or flash the two cards to be swapped to alert the player that a swap situation is present as shown in FIG. 1. Any suitable display mechanism can be used.

When the player is alerted that a swap situation is present, the player selects whether or not to swap the cards for another card of the pair held by the player. A "SWAP" button can be provided on the button panel of the gaming machine and the player can press the "SWAP" button to effect the swap of cards. Alternatively, if touch screen technology is being employed, a touch screen "SWAP" panel can be provided for the player to make the swap selection.

If the player selects to make the swap, the two cards to be swapped (for example, the 6♠ and the 2♣) are removed from the player's hand on the video screen and replaced with the appropriate card to be paired from the pool of playing cards. The computer software that operates the gaming machine is programmed to select the next appropriate card from the pool of remaining cards that matches the pair held by the player.

Figure 2:
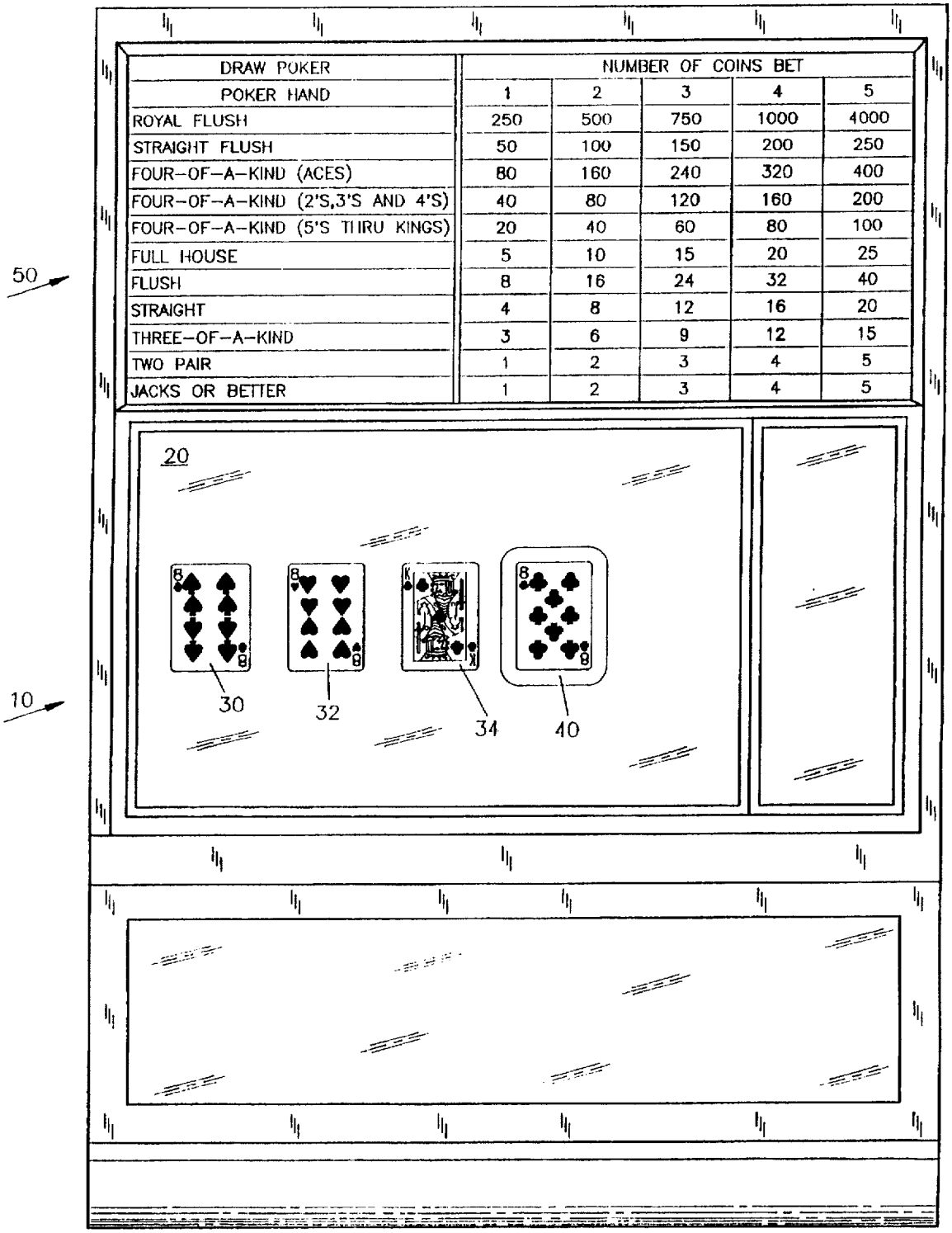
FIG. 2 shows a video screen display and pay table used in the method of the present invention after the player has accepted the swap of cards and before the player has discarded and drawn replacement cards.

As shown in FIG. 2, when the player selects to accept the swap, the 6♠ and the 2♣ are removed from the player's hand and replaced with the 8♣ 40. The player now holds three Eights and the remaining fourth card (the K♣) from the initial deal.

In the preferred embodiment of the present invention, the player is offered the opportunity to make this swap. The player may decide that his hand should be played without making the swap. For example, the player may initially be dealt an A♠, 10♠, 10♦, 6♠ and 4♠. In this situation, the player has four Spades to a Flush and the player may decide to decline to swap the 6♠ and the 4♠ for another Ten and try instead to draw to the Flush.

One of the attractive features of electronic video poker is the control the player has over the holding and discarding of cards. Many gaming jurisdictions consider electronic video poker to be a game of skill and, by allowing the player to decide whether to make the swap of cards when he is eligible to do so, this decision required by the player contributes to the skill aspect of the method of play.

Alternatively, the swap may be mandatory and the player will not have a choice whether to accept the swap. In such a situation, the computer controls of the gaming machine 10 automatically effect the swap of the cards and automatically provides the player with the next card in the deck that matches the pair.

After the player accepts the swap of cards, the player then discards and draws replacement cards to attempt to further improve his hand.

After the draw step, the player's hand is evaluated to determine if a winning card combination exists and the player is paid an award based on the amount wagered by the player in accordance with a pay table.

Figure 3:
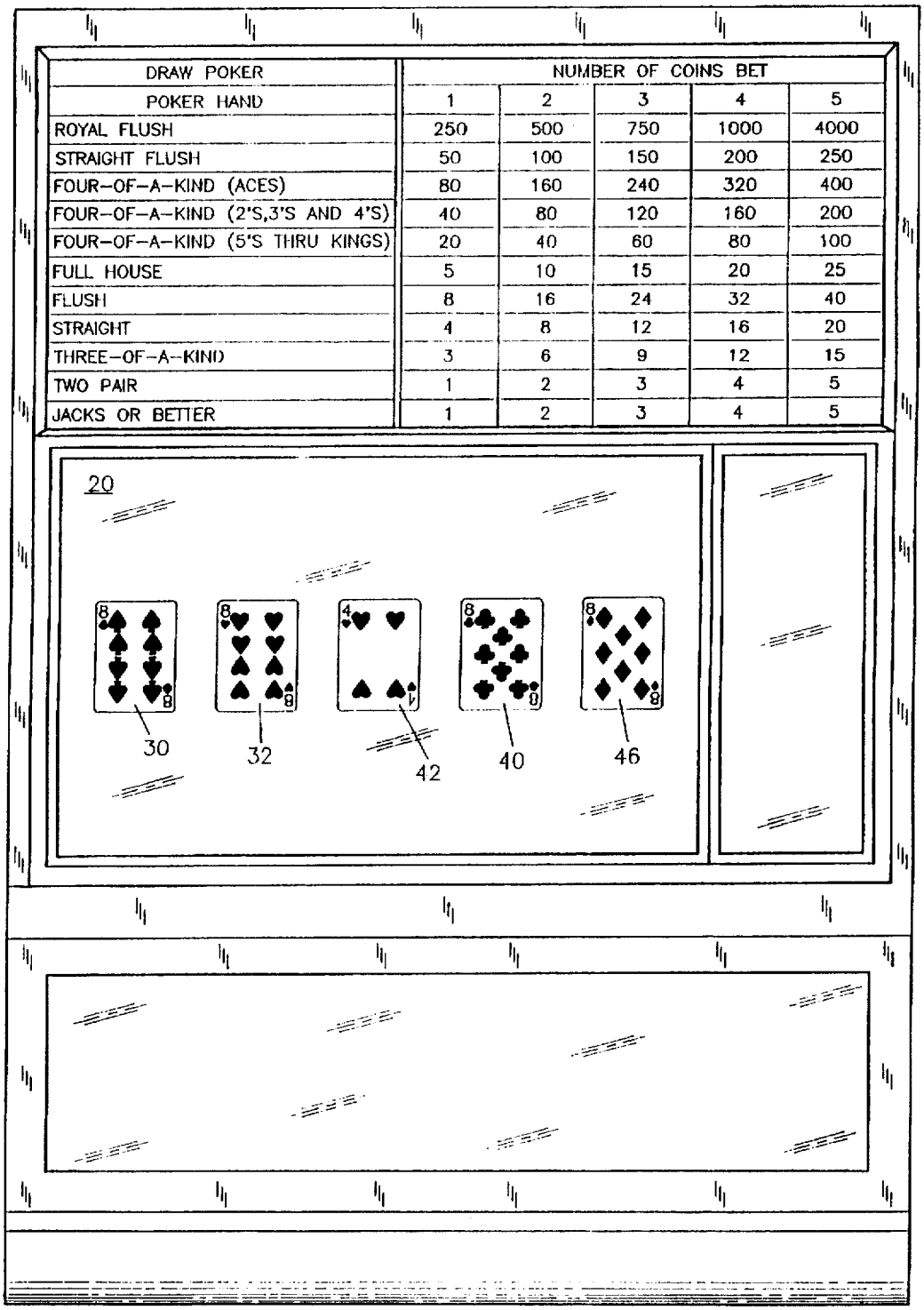
FIG. 3 shows a video screen display and pay table used in the method of the present invention showing the final five card hand of the player after the draw step has occurred.

As shown in FIG. 3, the player has held the three Eights and discarded the remaining card, the K♣. The two replacement cards for the draw step are dealt to the player: the 4♥ 42 and the 8♦ 46 which means the player's final hand is a Four-of-a-Kind.

Table B shows a typical pay table that can be used with the method of the present invention.

TABLE B

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

The pay table shown in Table B is based on a conventional Double Bonus Poker pay table modified to reflect that Full Houses will occur more often when the swap possibility exists. Any suitable pay table can be used with the method of the present invention based on the hold percentage desired to be employed by the operator of the gaming machine.

Other modifications of the present invention may be employed. If three of the cards from the initial deal form a three-of-a-kind (ranging in rank from Deuces through Tens) and the remaining two cards add up in numerical value to the numerical rank of the three-of-a-kind, then the player can be offered a swap possibility to improve his hand to a four-of-a-kind.

In another variation of the present invention, all of the ranks of cards are available as potential swap cards. In addition to the Deuces through Tens (which have a numerical value equal to their pips), the Jacks, Queens, Kings and Aces are also included. The numerical value of the Jack is 11, the Queen is 12, the King is 13 and the Ace is 14 or 1.

For example, if the player is dealt the A♠, the A♥, the 2♣, the Q♦ and the 7♦ as his initial five cards, the 2♣ and the Q♦ add up numerically to 14 which is the numerical value of an Ace. Therefore, the player is offered the opportunity to swap the 2♣ and the Q♦ for another Ace.

Another variation of the present invention expands the swap concept to situations in which any two groups of the player's initially dealt cards add up, subtract from, multiply with or divide with each other to the same numerical value, then the player has the option of swapping the two groups of cards to create a pair or a three-of-a-kind prior to the draw step. This variation also includes situations in which combinations of addition, subtraction, multiplication or division are used.

In this variation of the present invention, the numerical value of the Deuce through Ten is the value of their pips and the Jack is 11, the Queen is 12, the King is 13 and the Ace is 14 or 1.

First Addition Example. The player's initial five card hand is the 8♥, the 6♠, the 9♣, the 5♠ and the K♦. The 8♥ and 6♠ add up to a numerical value of 14. The 9♣ and the 5♠ also add up to a numerical value of 14. Since 14 is the numerical value of an Ace, the 8♥ and the 6♠ combine to swap out for an Ace (e.g. the A♣) and the 9♣ and the 5♠ combine to swap out for another Ace (e.g. the A♠). The player then has a pair of Aces (and the K♦) and proceeds to the draw step. The player would probably hold the pair of Aces, discard the K♦ and draw three cards in an attempt to improve his final hand.

Second Addition Example. The player's initial five card hand is the 8♥, the 6♠, the 7♣, the 5♠ and the 2♦. The 8♥ and 6♠ add up to a numerical value of 14. The 7♣, the 5♠ and the 2♦ also add up to a numerical value of 14. Since 14 is the numerical value of an Ace, the 8♥ and the 6♠ combine to swap out for an Ace (e.g. the A♣) and the 9♣, the 5♠ and the 2♦ combine to swap out for another Ace (e.g. the A♠). The player then has a pair of Aces and proceeds to the draw step. The player would probably hold the pair of Aces and draw three cards in an attempt to improve his final hand.

Third Addition Example. The player's initial five card hand is the 4♥, the 4♦, the K♥, the A♣ and the 3♠. The A♣ and the 3♠ add up to a numerical value of 4. The player can swap out these two cards for another Four (e.g. the 4♣). The player then has a three-of-a-kind in Fours and proceeds to the draw step. The player would probably hold the three Fours, discard the K♥ and draw two cards in an attempt to improve his final hand.

Fourth Addition Example. The player's initial five card hand is the 4♥, the 4♦, the 4♠, the A♣ and the 3♠. The A♣ and the 3♠ add up to a numerical value of 4. The player can swap out these two cards for another Four (e.g. the 4♣). The player then has a four-of-a-kind in Fours and proceeds to the draw step or simply hold the four Fours since in this example the draw step will not improve the player's hand.

Fifth Addition Example. The player's initial five card hand is the 6♥, the 6♦, the A♥, the 2♣ and the 3♦. The A♥, the 2♣ and the 3♦ add up to a numerical value of 6. The player can swap out these three cards for another Six (e.g. the 6♣). The player then has a three-of-a-kind in Sixes and proceeds to the draw step. The player would probably hold the three Sixes and draw two cards in an attempt to improve his final hand.

Subtraction Example. The player's initial five card hand is the 7♥, the 7♦, the K♥, the 9♠ and the 2♣. The 9♠ minus the 2♣ equals to a numerical value of 7. The player can swap out these two cards for another Seven (e.g. the 7♣). The player then has a three-of-a-kind in Sevens and proceeds to the draw step. The player would probably hold the three Sevens and draw two cards in an attempt to improve his final hand.

Multiplication Example. The player's initial five card hand is the 8♥, the 8♦, the K♠, the 4♥ and the 2♣. The 4♥ multiplied by the 2♣ equals to a numerical value of 8. The player can swap out these two cards for another Eight (e.g. the 8♣). The player then has a three-of-a-kind in Eights and proceeds to the draw step. The player would probably hold the three Eights and draw two cards in an attempt to improve his final hand.

Division Example. The player's initial five card hand is the K♥, the 4♦, the 4♠, the 8♥ and the 2♦. The 8♥ divided by the 2♦ equals to a numerical value of 4. The player can swap out these two cards for another Four (e.g. the 4♣). The player then has a three-of-a-kind in Fours and proceeds to the draw step. The player would probably hold the three Fours, discard the K♥ and draw two cards in an attempt to improve his final hand.

Combination Example. The player's initial five card hand is the 9♥, the 9♦, the 4♠, the 2♣ and the A♣. The 4♠ times the 2♣ equals to a numerical value of 8. This numerical value of 8 is then added to the A♣ to yield a numerical value of 9. The player can swap out these three cards for another Nine (e.g. the 9♣). The player then has a three-of-a-kind in Nines and proceeds to the draw step. The player would probably hold the three Nines and draw two cards in an attempt to improve his final hand.

The method of the present invention can also be applied to any of the conventional electronic video poker variations using Jokers or wild cards. The pay table need only be adjusted to the reflect the probability of achieving the various winning hand combinations that are possible when the swap feature is employed in conjunction with the video poker variation being used.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a draw poker game comprising:

a) dealing a player an initial five card hand from a pool of playing cards;

b) if the initial five card hand includes a pair of cards having a numerical rank from Deuce through Ten and if two of the remaining cards add up in numerical rank to the same rank as the pair of cards, offering the player the opportunity to obtain a third card to form a three-of-a-kind by swapping the two of the remaining cards that add up in numerical rank to the pair of cards;

c) if the player accepts the swap offer, replacing the two swapped cards with a third card from the pool of cards to form a three-of-a-kind;

d) the player discarding one or more cards from the remaining cards of the initial hand;

e) dealing the player replacement cards from the pool of playing cards for the discarded cards, if any;

f) determining a value for the player's selected hand based on poker hand ranking; and g) awarding the player a predetermined amount based on the value of the player's selected hand.

2. The method of claim 1 further including the steps of:

a) the player making a wager to participate in the play of the game; and b) the predetermined amount awarded to the player being based on the amount of the wager.

3. The method of claim 1 in which the value of the player's selected hand is determined by comparing the poker hand ranking of the player's selected hand to a pay table.

4. The method of claim 3 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

5. A method of playing a draw poker game comprising:

a) dealing a player an initial five card hand from a pool of playing cards;

b) if the initial five card hand includes a three-of-a-kind of cards having a numerical rank from Deuce through Ten and if two of the remaining cards add up in numerical rank to the same rank as the three-of-a-kind of cards, offering the player the opportunity to obtain a third card to form a four-of-a-kind by swapping the two of the remaining cards that add up in numerical rank to the three-of-a-kind of cards;

c) if the player accepts the swap offer, replacing the two swapped cards with a third card from the pool of cards to form a four-of-a-kind;

d) the player discarding one or more cards from the remaining cards of the initial hand;

e) dealing the player replacement cards from the pool of playing cards for the discarded cards, if any;

f) determining a value for the player's selected hand based on poker hand ranking; and g) awarding the player a predetermined amount based on the value of the player's selected hand.

6. The method of claim 5 further including the steps of:

a) the player making a wager to participate in the play of the game; and b) the predetermined amount awarded to the player being based on the amount of the wager.

7. The method of claim 5 in which the value of the player's selected hand is determined by comparing the poker hand ranking of the player's selected hand to a pay table.

8. The method of claim 7 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

9. A method of playing a draw poker game comprising:

a) dealing a player an initial five card hand from a pool of playing cards;

b) designating the numerical value of the playing cards to be the value of their pips, the Jacks having a numerical value of 11, the Queens having a numerical value of 12, the Kings having a numerical value of 13 and the Aces having a numerical value of 14 or 1;

c) if the initial five card hand includes a pair of cards and if two of the remaining cards add up in numerical rank to the same rank as the pair of cards, offering the player the opportunity to obtain a third card to form a three-of-a-kind by swapping the two of the remaining cards that add up in numerical rank to the pair of cards;

d) if the player accepts the swap offer, replacing the two swapped cards with a third card from the pool of cards to form a three-of-a-kind;

e) the player discarding one or more cards from the remaining cards of the initial hand;

f) dealing the player replacement cards from the pool of playing cards for the discarded cards, if any;

g) determining a value for the player's selected hand based on poker hand ranking; and h) awarding the player a predetermined amount based on the value of the player's selected hand.

10. The method of claim 9 further including the steps of:

a) the player making a wager to participate in the play of the game; and b) the predetermined amount awarded to the player being based on the amount of the wager.

11. The method of claim 9 in which the value of the player's selected hand is determined by comparing the poker hand ranking of the player's selected hand to a pay table.

12. The method of claim 11 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

13. A method of playing a draw poker game comprising:

a) dealing a player an initial five card hand from a pool of playing cards;

b) designating the numerical value of the playing cards to be the value of their pips, the Jacks having a numerical value of 11, the Queens having a numerical value of 12, the Kings having a numerical value of 13 and the Aces having a numerical value of 14 or 1;

c) if the initial five card hand includes a three-of-a-kind of cards and if two of the remaining cards add up in numerical rank to the same rank as the three-of-a-kind of cards, offering the player the opportunity to obtain a third card to form a four-of-a-kind by swapping the two of the remaining cards that add up in numerical rank to the three-of-a-kind of cards;

d) if the player accepts the swap offer, replacing the two swapped cards with a third card from the pool of cards to form a four-of-a-kind;

e) the player discarding one or more cards from the remaining cards of the initial hand;

f) dealing the player replacement cards from the pool of playing cards for the discarded cards, if any;

g) determining a value for the player's selected hand based on poker hand ranking; and h) awarding the player a predetermined amount based on the value of the player's selected hand.

14. The method of claim 13 further including the steps of:

a) the player making a wager to participate in the play of the game; and b) the predetermined amount awarded to the player being based on the amount of the wager.

15. The method of claim 13 in which the value of the player's selected hand is determined by comparing the poker hand ranking of the player's selected hand to a pay table.

16. The method of claim 15 in which the pay table comprises:

| DRAW POKER | NUMBER OF COINS BET | | | | |
|---|---|---|---|---|---|
| POKER HAND | 1 | 2 | 3 | 4 | 5 |
| ROYAL FLUSH | 250 | 500 | 750 | 1000 | 4000 |
| STRAIGHT FLUSH | 50 | 100 | 150 | 200 | 250 |
| FOUR-OF-A-KIND (ACES) | 80 | 160 | 240 | 320 | 400 |
| FOUR-OF-A-KIND (2'S, 3'S AND 4'S) | 40 | 80 | 120 | 160 | 200 |
| FOUR-OF-A-KIND (5'S THRU KINGS) | 20 | 40 | 60 | 80 | 100 |
| FULL HOUSE | 5 | 10 | 15 | 20 | 25 |
| FLUSH | 8 | 16 | 24 | 32 | 40 |
| STRAIGHT | 4 | 8 | 12 | 16 | 20 |
| THREE-OF-A-KIND | 3 | 6 | 9 | 12 | 15 |
| TWO PAIR | 1 | 2 | 3 | 4 | 5 |
| JACKS OR BETTER | 1 | 2 | 3 | 4 | 5 |

* * * * *